US005581046A

United States Patent [19]

Weldle et al.

[11] Patent Number: 5,581,046

[45] Date of Patent: Dec. 3, 1996

[54] HAND-HELD FIREARM WITH RECOIL ATTENUATION

[75] Inventors: Helmut Weldle; Hermann Albrecht, both of Oberndorf/Neckar, Germany

[73] Assignee: Heckler & Koch GmbH, Oberndorf/Neckar, Germany

[21] Appl. No.: 349,635

[22] Filed: Dec. 2, 1994

[30] Foreign Application Priority Data

Dec. 2, 1993 [DE] Germany ..... 43 41 131.2

[51] Int. Cl.[6] ..... F41A 25/12

[52] U.S. Cl. ..... 89/196; 89/177; 89/163

[58] Field of Search ..... 89/196, 163, 177, 89/198

[56] References Cited

U.S. PATENT DOCUMENTS

| | | | |
|---|---|---|---|
| 684,055 | 10/1901 | Gabbett-Fairfax | 89/196 |
| 2,776,602 | 1/1957 | Sturtevant | 89/196 |
| 2,846,926 | 8/1958 | Kimball | 89/196 |
| 2,889,753 | 6/1959 | Whitney | 89/163 |
| 3,504,594 | 4/1970 | Greeley | 89/163 |
| 3,731,590 | 5/1973 | Zimmerman, Jr. | 89/163 |
| 3,901,125 | 8/1975 | Raville | 89/163 |
| 4,485,723 | 12/1984 | Sarony | 89/163 |
| 4,522,107 | 6/1985 | Woodcock et al. | 89/196 |
| 4,677,897 | 7/1987 | Barrett | 89/166 |
| 4,947,730 | 8/1990 | Byron | 89/146 |
| 5,309,815 | 5/1994 | Möller et al. | 89/163 |
| 5,415,075 | 5/1995 | Moon | 89/163 |
| 5,425,300 | 6/1995 | Ghisoni | 89/163 |

FOREIGN PATENT DOCUMENTS

| | | | |
|---|---|---|---|
| 2063178 | 8/1982 | Canada | 89/163 |
| 2590012 | 5/1987 | France | 89/178 |
| 182757 | 4/1907 | Germany . | |
| 211505 | 7/1909 | Germany . | |
| 1040420 | 10/1958 | Germany . | |
| 4109777 | 7/1993 | Germany . | |
| 494384 | 9/1969 | Switzerland . | |
| WO86/02153 | 4/1986 | WIPO . | |

*Primary Examiner*—Michael J. Carone
*Assistant Examiner*—Christopher K. Montgomery
*Attorney, Agent, or Firm*—Cohen, Pontani, Lieberman, Pavane; Christa Hildebrand

[57] ABSTRACT

The invention discloses a hand-held firearm with a barrel assembly (2, 18, 36, & 54) moving back and forth essentially in or opposite the direction the weapon is fired in between a forward and a rear stop (44, 48, & 50) on or in a frame or grip assembly (12). A breech assembly (6 & 32) that moves back and forth essentially in the same direction as the barrel assembly between a forward and closed position and a rear and open position, moving out of the closed position and into the open position against the force of a closure spring (16) and, at the end of its return stroke, the frame or grip assembly or a component (64 or 64') resting off it. A buffering spring (66) tensions the barrel assembly toward the forward stop (44 or 50) and buffers its contact with the rear stop (44 or 48). The closure spring (16) and the buffering spring (66) are correlated to ensure that the breech assembly will strike the frame or grip assembly or the component supported off it essentially at the instant the barrel assembly comes into contact with the forward stop.

12 Claims, 8 Drawing Sheets

HAND-HELD FIREARM WITH RECOIL ATTENUATION

BACKGROUND OF THE INVENTION

1. Field of the Invention

This present invention relates to a firearm, especially hand-held, with a barrel assembly accommodated in a frame and a breech assembly. The barrel assembly moves or travels back and forth in the direction of fire between a forward stop and a rear stop. The breech assembly moves or travels back and forth essentially paralleling the barrel assembly between a forward and closed position and a rear and open position. The breech assembly moves back out of the closed position and into the open position against the force of a closure spring and strikes the frame or a component that rests off the frame. A buffering spring tensions the barrel assembly toward the forward stop and buffers it as it contacts the rear stop.

2. Description of the Related Art

A firearm of this type is known from DE 4 109 777 C2, assigned to common assignor Heckler & Koch.

The terms "up," "down," "forward," and "rear" will be employed hereinafter with reference to the weapons normal firing position with the barrel level and its mouth forward.

In designing hand-held firearms it is important to minimize recoil to the greatest extent possible. It should in particular be weak enough to prevent the shooter from flinching. Furthermore, there must be no risk at all of injury. Finally, the recoil must be particularly weak in automatic and semiautomatic weapons to maintain reasonable aim as firing resumes or continues.

In using and learning to use automatic weapons and in shooting sports quick aim and rapid bursts are often necessary. Aiming the weapon before first firing and re-aiming after each shot must accordingly proceed rapidly.

Although a very light-weight weapon can of course be handled rapidly and easily, it does not have enough mass to counteract recoil successfully and will accordingly wander far off target after every shot. A heavy weapon on the other hand will of course counteract recoil better but is difficult and accordingly time-consuming to aim, especially initially.

The barrel of a bolt-action and recoil-powered automatic firearm interlocks with the breech before the weapon is fired. When the weapon is fired the barrel-and-breech assembly moves back in accordance with the conservation of momentum. During this motion the interlocking mechanism opens and the barrel and breech complete the motion separately. The barrel initially encounters an obstacle, usually the frame. Finally, the breech, moving against the force of a recuperator spring, also encounters an obstacle, usually also the frame, that constitutes the destination of its travel.

The barrel assembly, the barrel and the components associated with and moving along with it, that is, exerts an momentum on the frame as it comes into contact with it. The frame forwards the momentum to the shooter in the form of recoil. The breech assembly, the breech and the components associated with and moving along with it, that is, exert an increasing force as it travels back on the recuperator spring. The reaction of the spring against the frame is also perceived by the shooter as recoil. Finally, the breech assembly strikes the frame and forwards a renewed momentum to it, which impulse is also forwarded to the shooter.

The rebound of the breech assembly off the frame is responsible for most of the recoil. Attenuating this component with a buffering spring at the rear end of the path traveled by the assembly is known. Such a spring decelerates the impact and accordingly weakens the momentum. Such an approach, however, is impossible to employ in hand-held firearms. It would in fact extend the backward travel of the breech considerably beyond what is necessary for recharging. The weapon itself, which of course must be as small as possible, would have to be longer. Finally, this method of attenuation would make the weapon too heavy.

The above-cited reference DE 4 109 777 C2 discloses one possible solution to the problem. Although the impact of the barrel assembly is attenuated with a buffering spring, the spring range does not add to the length of the barrel. The rear of the reacting barrel enters a space above the clip accommodation but without impeding alignment of the uppermost cartridge within that space. The barrel is in fact forced farther forward by the spring before the breech has moved all the way back.

This design, however, seems to have exhausted all theoretical possibilities for attenuating the recoil.

SUMMARY OF THE INVENTION

The object of the present invention is to attenuate recoil even more extensively and apparently subject to the aforesaid conditions. This object is attained in accordance with the present invention in the generic firearm initially described herein in that the closure spring and the buffering spring are correlated to ensure that the breech assembly will strike the frame or the component that rests against it and the barrel assembly will contact its forward stop essentially simultaneously.

The spring characteristics of the buffering spring and the closure spring are, in contrast to the state of the art, correlated such that the buffering spring will force the barrel assembly against its stop and the closure spring will force the breech assembly against its stop essentially simultaneously. The barrel assembly will accordingly arrive at its forward stop as precisely as possible at the instant the breech assembly reaches the end of its return stroke. The rearward momentum of the breech assembly against the frame, the grip assembly, or the component resting off the frame will be alleviated by the simultaneous but opposite momentum of the barrel assembly against the forward stop. The rearward momentum of the breech assembly, which is responsible for the major component of recoil perceived by the shooter as unpleasant, will be definitely alleviated by the counteracting momentum of the powerfully forward striking barrel assembly.

The firearm in accordance with the present invention can be an automatic weapon with the return stroke of the breech being exploited even while it is opening to actuate a cartridge-chambering mechanism (more or less like a belt feed) or with the return stroke inhibited by the cartridge-chambering mechanism (by friction from a cartridge resting against the breech for example). The characteristics of the buffering spring and closure spring in such a firearm are intended for firing that involves automatic chambering. The springs are accordingly no longer precisely adapted to the final round, the round after which no chambering and hence only a slight inhibition of the breech motion if any occur. It is only during this final round that recoil compensation will be weaker.

It is of particular advantage for the frame or grip assembly or the component that rests off it to be plastic or fiber-reinforced plastic, first because the recoil attenuated in accordance with the present invention makes it possible to employ a lighter-weight weapon and second because the inherent hysteresis of plastic compensates at least to some extent for contamination of the spring-characteristic adjustment and an accordingly concomitant temporal displacement of the contradictory momentum data.

Further preferred embodiments of the invention are recited in the further claims.

It is of particular advantage for the rod that maintains the closure spring in alignment to be part of the barrel assembly, to participate in its unlocking action, and to support a flange or bush that constitutes the stop for the breech assembly and for the breech assembly, during its return stroke, to strike the flange while the flange is moving forward most rapidly. The latter situation usually occurs as the barrel assembly arrives at its forward stop.

Tests have been conducted on a pistol in accordance with the present invention and with a plastic grip accommodating a 9 mm Parabellum cartridge but without the spring adjustment in accordance with the present invention. A pistol of essentially the same design was then built for the considerably heavier 10 mm Auto cartridge, again without the spring adjustment in accordance with the present invention. Long-term tests indicate that the recoil from the weapon accommodating the heavier ammunition is perceptibly no more powerful than the recoil from the conventional version accommodating the smaller cartridge. The grip on the version adapted to the heavier ammunition was definitely strong enough even though it was only plastic.

Embodiments of the present invention will now be specified by way of example with reference to the accompanying drawing.

The figures and associated text differ from the content of the above-cited DE 4 109 777 C2 only in the essentially countervailing characteristics of the buffering and closure springs.

It must accordingly be particularly emphasized that the closure spring and the buffering spring are correlated to ensure that the breech assembly will arrive at its rearmost position (FIG. 3*d*) as the spring-alignment rod, which is part of the barrel assembly, arrives at its farthest forward position and its bush strikes the breech block from the rear.

Since the actions of both the generic firearm and the firearm in accordance with the present invention will be most evident from comparison with a firearm at the state of the art, the state of the art is also represented in the drawing.

DESCRIPTION OF THE PREFERRED EMBODIMENT(S)

Figure 1A:
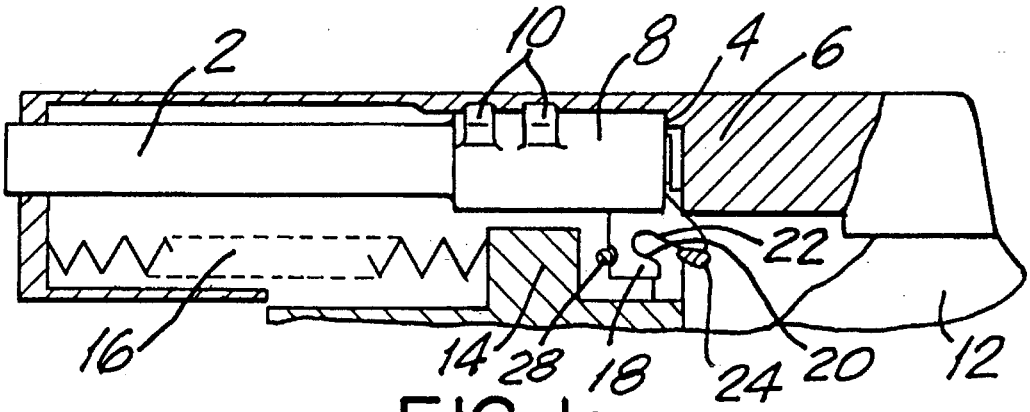
FIG. 1a PRIOR ART
FIGS. 1*a* through 1*c* illustrate a known Colt-Browning system with a cam and a bolt at various stages of operation.
Figure 1B:
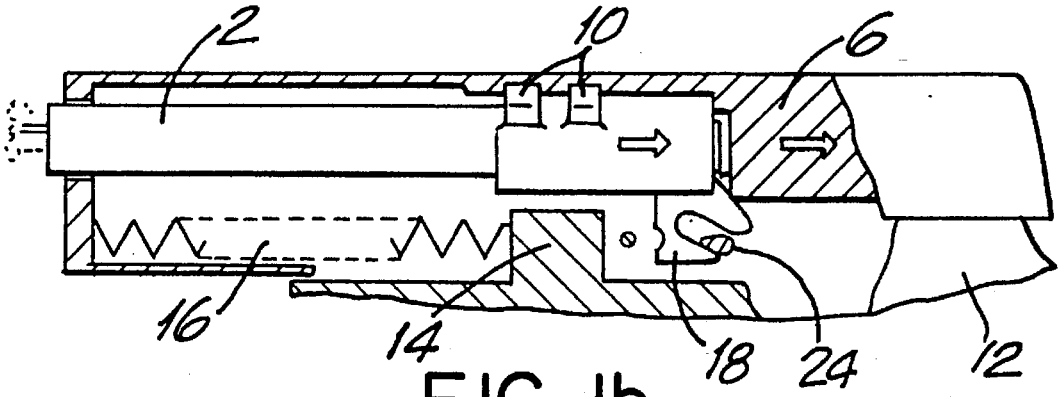
FIG. 1b PRIOR ART
Figure 1C:
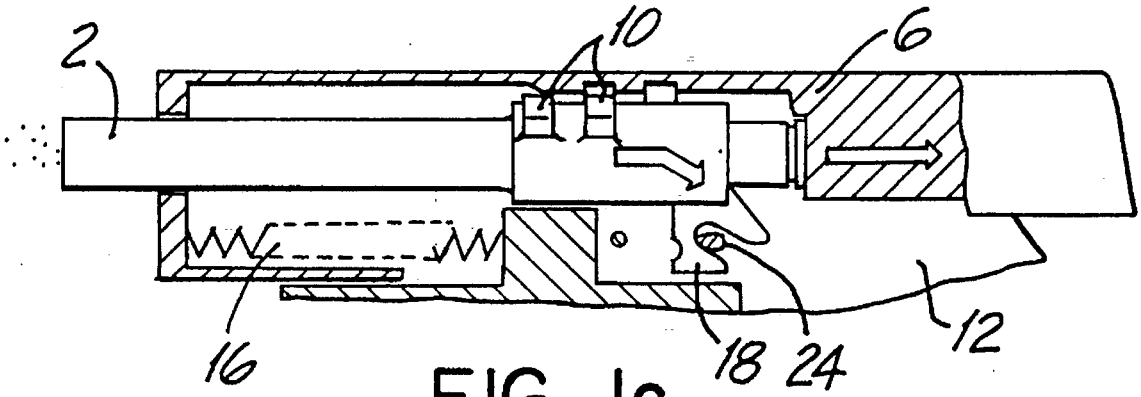
FIG. 1c PRIOR ART
Figure 2A:
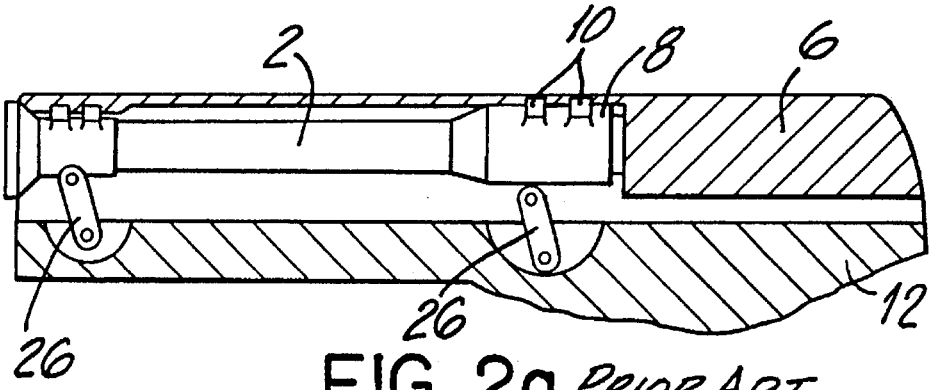
FIG. 2a PRIOR ART
FIGS. 2*a* through 2*c* illustrate another known system with a four-link transmission at various stages of operation.
Figure 2B:
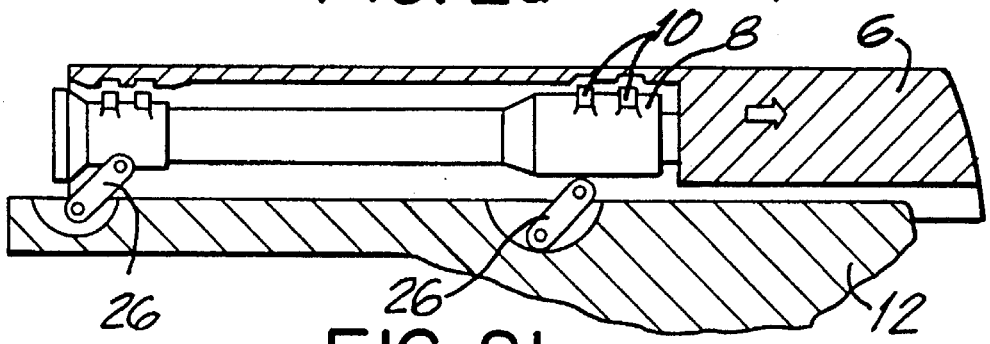
FIG. 2b PRIOR ART
Figure 2C:
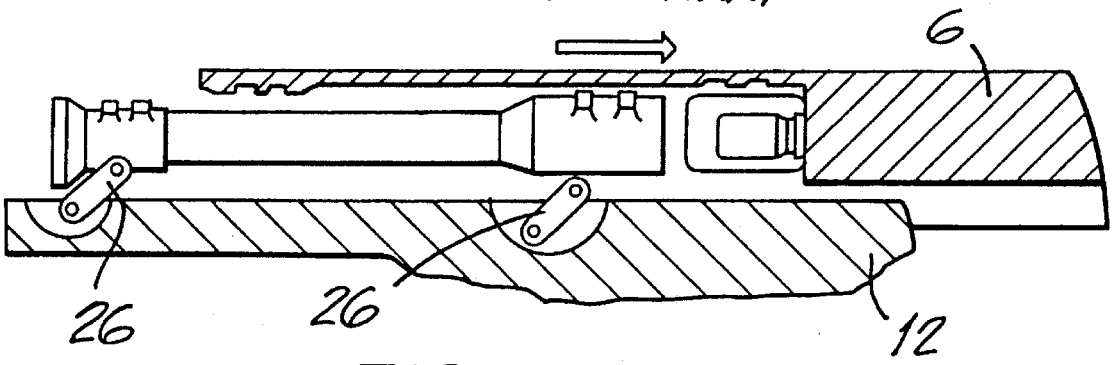
FIG. 2c PRIOR ART

To improve comprehension of the invention, pistols of the Colt-Browning type are illustrated in FIGS. 1 and 2. These weapons are of the type called bolt-action.

A pivoting barrel 2 rests against the face 4 of a breech block 6. The rear of barrel 2 constitutes a chamber 8. At the top of chamber 8 are interlocking nipples 10 that engage matching depressions in breech block 6 and rigidly secure barrel 2 to it prior to firing.

Pistols of this type also have a grip assembly 12. The unillustrated grip usually accommodates a replaceable clip. Breech block 6 slides back and forth on grip assembly 12. When a shot is fired the bullet in accelerated forward. The familiar recoil occurs in compliance with the law of conservation of momentum and forces barrel 2 back along with breech 6. Breech 6 now executes a longitudinal return stroke or opening motion out of the ready-to-fire state and strikes a breech-motion stop 14 mounted stationary on the frame. This action is executed against the force of a recoil spring 16 below and essentially paralleling barrel 2.

The bottom of the chamber 8 illustrated in FIG. 1 supports a projection 18 with a cam composed essentially of an unlocking section 20 and a locking section 22.

When the weapon is fired, barrel 2 travels a stroke s to the rear along with breech 6. Barrel 2 is subsequently disengaged from breech 6 either in conjunction with a bolt 24 mounted on the frame and engaging unlocking cam section 20 (FIG. 1) or subject to links 26 (FIG. 2). Breech 6 now moves on alone and strikes a breech-motion stop 14 secured to the frame, reverses, and is accelerated forward by recoil spring 16, executing a forward stroke or closure motion.

The forward breech stroke transfers a fresh cartridge from the clip to chamber 8. Barrel 2 is then pivoted up by the illustrated mechanisms and locked to breech 6 again. Barrel 2 and breech block 6 slide forward together until projection 18 strikes a transverse pin 28 mounted stationary on the frame, whereupon barrel 2 and breech block 6 come to a stop in the ready-to-fire state.

The cartridge is fired, and the procedure repeated from the beginning.

There is a very wide range of possible embodiments of the Colt-Browning system just described herein. Common to all is that at least the rear of the barrel, as it moves to the rear along with the breech block, swings down and releases it.

The embodiments illustrated by way of example in FIGS. 3*a* to 3*e* derive from the Colt-Browning system illustrated in FIG. 1 and exploit some of the functionally identical and similar components. The portions of the specification devoted to that embodiment will accordingly not be repeated. Functionally identical and similar components, however, are assigned the same reference numbers.

Figure 3A:
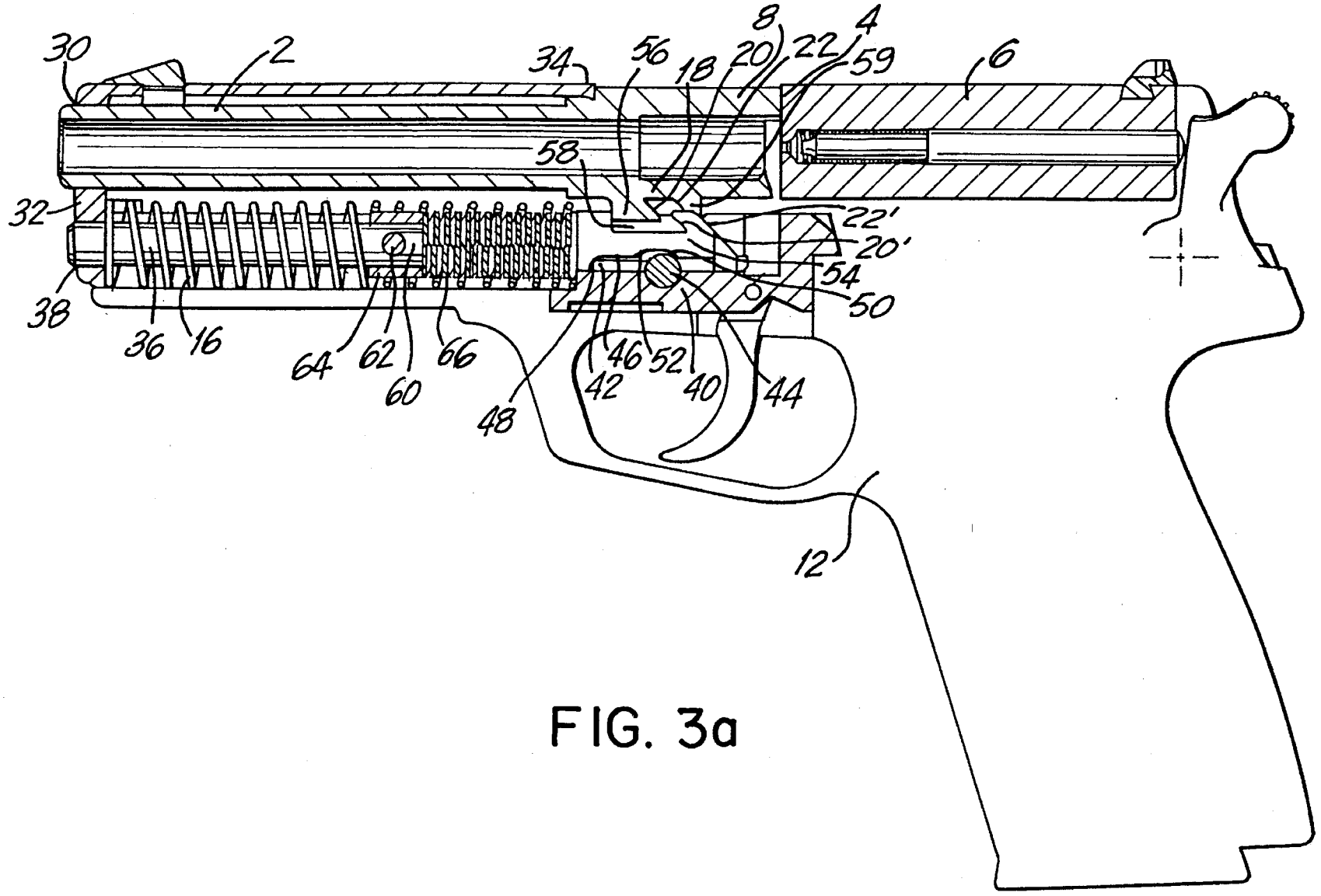
FIG. 3*a* is a vertical section through an embodiment wherein the present invention can be included. The embodiment is represented ready to fire.

The automatic pistol illustrated in FIG. 3*a* incorporates the previously described bolt action of the Colt-Browning system. Its major components are a grip assembly 12, a movable breech block 6, and a pivoting barrel 2. Barrel 2 rests in a hollow in breech block 6, with its mouth extending through a bore 30 in the forward end 32 of breech block 6. The rear end of the rear of barrel 2, chamber 8, that is, rests against face 4 and a shoulder at the forward end rests against a stop 34 on breech block 6.

A spring-positioning rod 36 slides back and forth below and paralleling barrel 2 in grip assembly 12. The forward end of rod 36 extends through a rod-centering bore 38 at the forward end 32 of breech block 6. Recoil spring 16 rests against spring-positioning rod 36 with its forward end against a chamber component 40 secured to the frame. It will be evident that spring 16 tends to force breech block 6 into the ready-to-fire position and in addition that it is compressed by breech block 6 as the latter executes its return stroke or opening motion.

The bottom of the rear end of spring-positioning rod 36 rests against the surface of chamber component 40 and can slide back and forth to a limited extend along it. An elongated and essentially trough-shaped recess 42 in the bottom of the rear end of spring-positioning rod 36 limits in conjunction with a transverse pin 44 secured to the frame the motion of rod 36 at both ends. The bottom 46 of recess 42 constitutes a cam demarcated by the forward and rear wall of recess 42. The forward wall will hereinafter be called rear stop 48 because it limits the rearward return stroke of spring-positioning rod 36 and hence of barrel 2. The rear wall will for similar considerations be called forward stop 50. Bottom 46 has in the vicinity of forward stop 50 a flat depression 52 that precisely matches the periphery of transverse pin 44. Depression 52 stabilizes spring-positioning rod 36 and transverse pin 44 with the firearm in various operation states, especially the ready-to-fire state.

The upper surface of the rear end of spring-positioning rod 36 faces barrel 2 and is provided with a barrel stop 54. Barrel stop 54 itself has a cam. A projection 18 faces it and has a complementary cam. The two cams function in accordance with the Colt-Browning principle. Projection 18 has for this purpose an extension 56 in the form of half a dovetail. The rear end of extension 56 constitutes an unlocking section 20. When barrel 2 and breech block 6 are forced back by the recoil, the unlocking section 20 on extension 56 slides down along a complementary unlocking section 20' on barrel stop 54 into another recess 58 in barrel stop 54. The action conventionally unlocks barrel 2 from breech block 6. The unlocked states are illustrated in FIGS. 3*b* to 3*e*.

Projection 18 has another extension 59 farther to the rear than extension 56. Extension 59 has a locking section 22. Locking section 22 and unlocking section 20 are essentially parallel and demarcate a sloping groove. The locking section 22 of extension 59 acts in conjunction with another locking section 22' on the rear face of barrel stop 54. When the mechanism is locked as illustrated in FIGS. 3*b* to 3*e*, the web of barrel stop 54 demarcated by unlocking sections 20 and 21' rests in the aforesaid groove in projection 18, between unlocking sections 20 and 20', that is.

When breech block 6 moves forward, executing its closing action, and forces barrel 2 back into the ready-to-fire position, locking sections 22 and 22' slide across each other and force the barrel back up into its locked position. With the barrel in this position, the surface of the free end of projection 59 rests on the surface of the web on barrel stop 54 that faces it. The forward end of projection 56 simultaneously rests against a corresponding demarcating surface on recess 58.

Figure 3B:
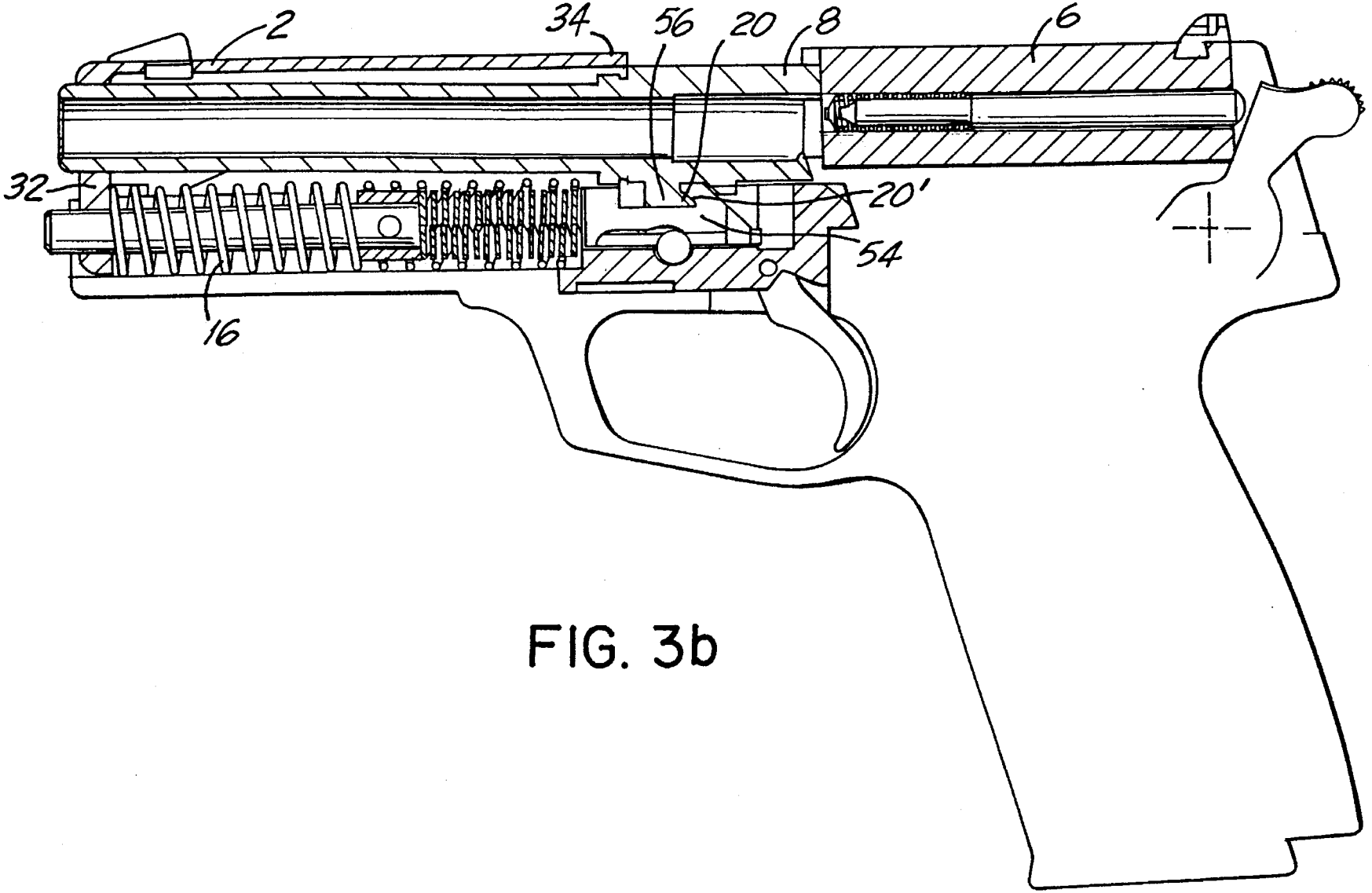
FIGS. 3*b* through 3*e* illustrate the embodiment illustrated in FIG. 3*a* at further operating stages.

The spring-positioning rod 36 illustrated in FIGS. 3*a* to 3*b* accommodates a slot 60. A pin 62 slides back and forth in slot 60. Pin 62 extends through a bush 64 that slides back and forth form-fitting on spring-positioning rod 36. Bush 64 is subject to the force of a buffering spring 66. The forward end of buffering spring 66 rests against bush 64. The rear end of buffering spring 66 rests along with recoil spring 16 against a chamber component 40 secured to the frame. Buffer spring 66 subjects bush 64 to force such that pin 62 rests against the forward end of slot 60. Spring-positioning rod 36 is accordingly also tensioned, although it is prevented from moving forward in that its forward stop 50 rests against transverse pin 44.

The interlocking barrel 2 and breech block 6 cannot move forward out of this position subject to recoil spring 16. The forward surface of projection 56, specifically, rests against the forward demarcating surface of the recess 58 in spring-positioning rod 36.

The recoil spring 16 in the present embodiment surrounds buffering spring 66 and bush 64. The forward face of bush 64 acts as a rear breech stop, a stop that the forward end 32 of breech block 6 rests against as the block executes its return stroke.

The buffering spring could basically also be positioned between grip assembly 12 and the rear free end of spring-positioning rod 36 and a rear breech stop on spring-positioning rod 36 more or less at the same level a bush 64.

How the illustrated bolt-action automatic pistol operates will now be described with reference to FIGS. 3*a* through 3*e*. To improve comprehension, only the components directly referred to are represented in the figure.

FIG. 3*a* illustrates the pistol locked and ready to fire. The unlocking section 20 on projection 18 is forward of the unlocking section 20' on barrel stop 54 to an extent that equals the stroke traveled by barrel 2 and breech block 6 during unlocking.

As the weapon is fired, barrel 2 and breech block 6 move backward together until unlocking sections 20 and 20' engage each other, unlocking section 20 slides down over unlocking section 20', and projection 56 comes to rest entirely in barrel stop 54. The revolution executed by barrel 2 in this phase is sufficient to release the engagement at stop 34 between chamber 8 and breech block 6 as illustrated in FIG. 3*b*.

Figure 3C:
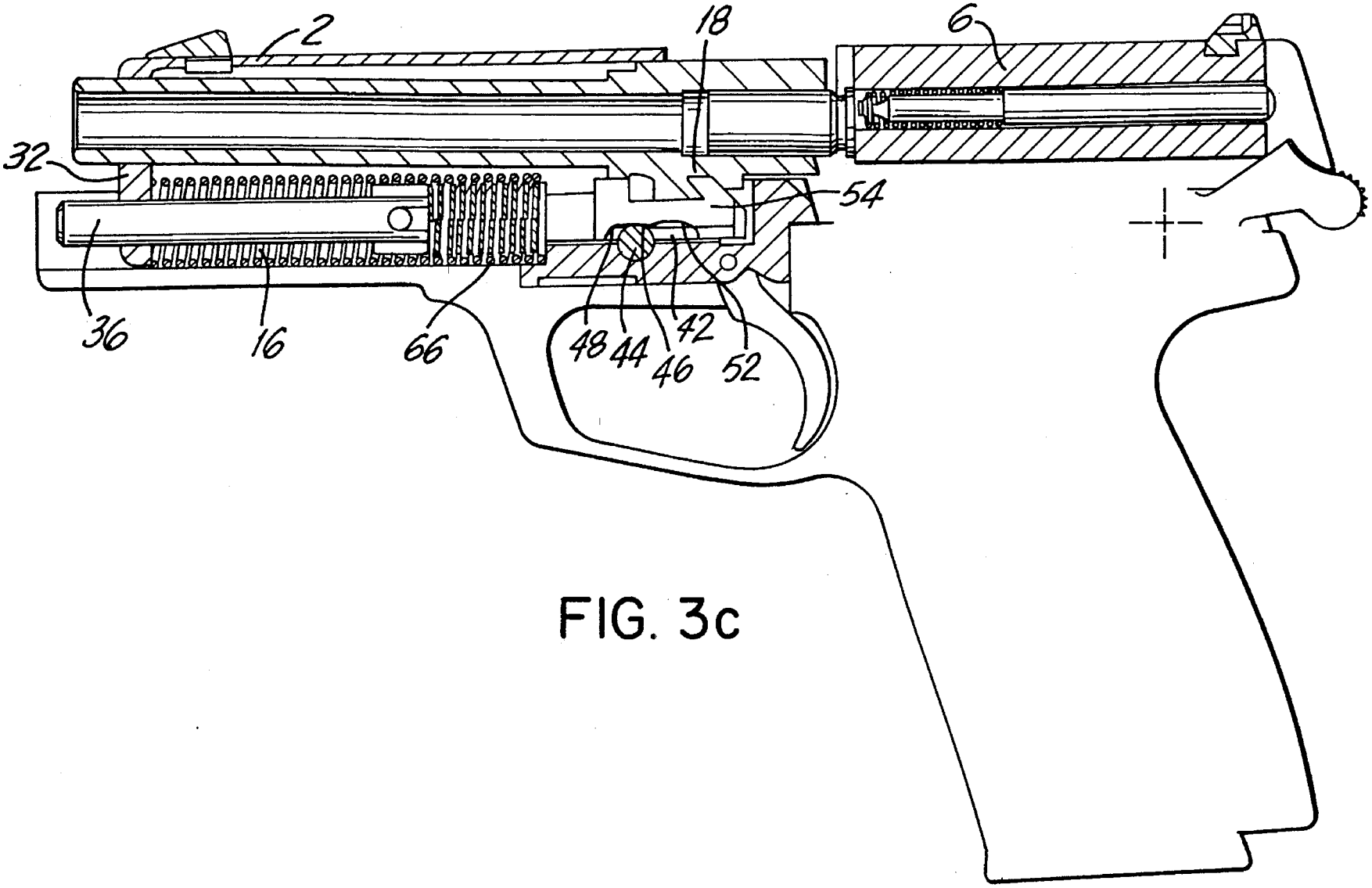

Breech block 6 can now move farther to the rear independently of barrel 2, continuing its opening motion, and its forward end 32 will come to rest against recoil spring 16 as illustrated in FIG. 3*c*.

While breech block 6 moves toward the rear, barrel 2, which is still in motion and has in the meantime become caught by spring-positioning rod 36, will drag the rod back against the force of buffering spring 66. The stabilizing engagement between transverse pin 44 and depression 52 is eliminated. The flat bottom 46 of elongated recess 42 arrives against transverse pin 44 and slides backward over it. Buffering spring 66 is farther compressed.

In this phase, buffered barrel stop 54 weakly captures projection 18. This weak-capture phase lasts only until the rear stop 48 on recess 42 comes into contact with transverse pin 44. Spring-positioning rod 36 is then moved to the rear against the force of buffering spring 66 only to the extent of elongated recess 42. Buffering spring 66 is accordingly simultaneously compressed. Barrel 2 and the spring-positioning rod 36 captured by it have come to a stop, although breech block 6 continues its return stroke.

Figure 3D:
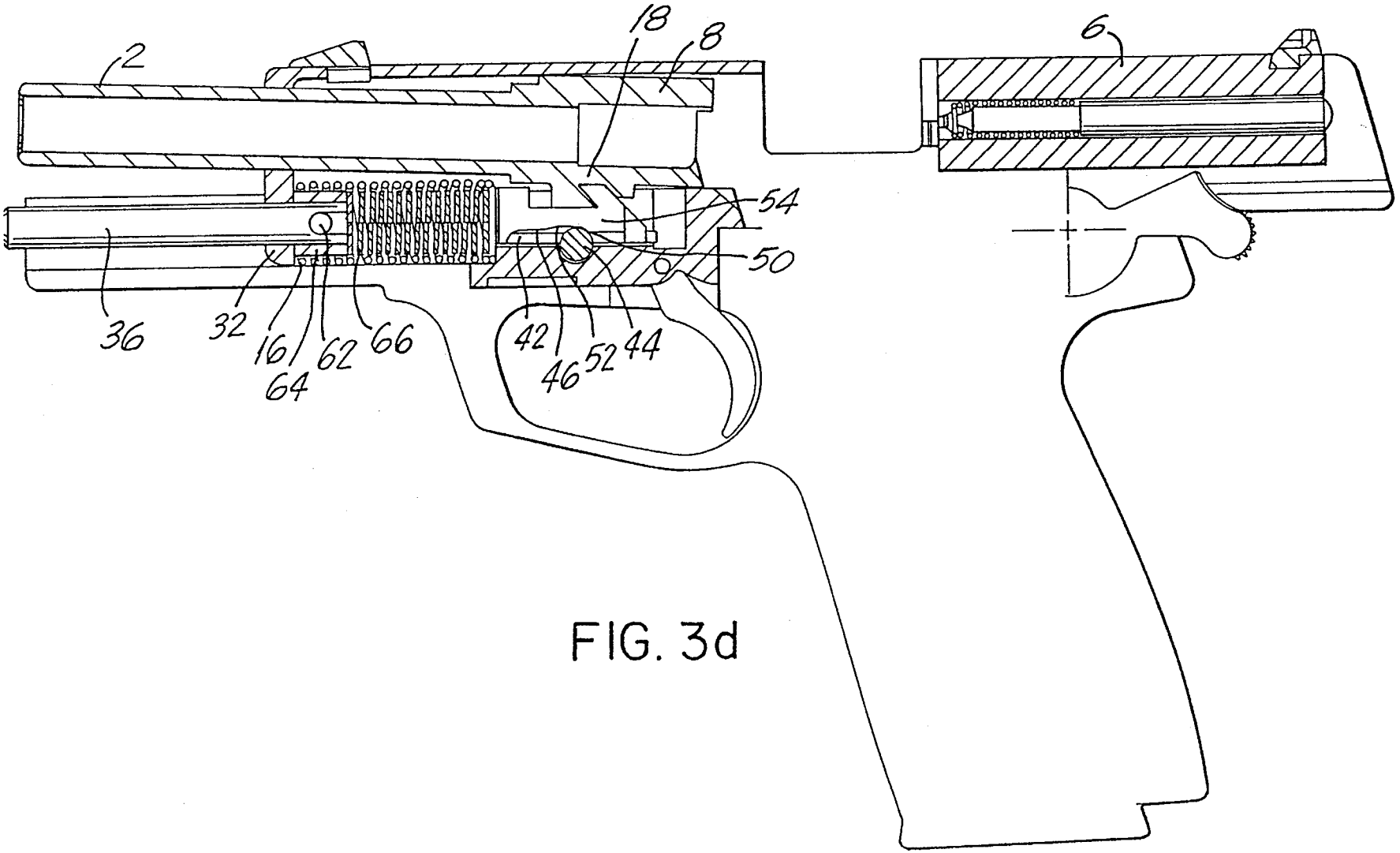

Buffering spring 66 now forces spring-positioning rod 36 forward again by way of 64 and the transverse pin 62 force-fit to it as illustrated in FIG. 3*d*. The bottom 46 of elongated recess 42 now slides forward over transverse pin 44. The barrel stop 54 on spring-positioning rod 36, which has been captured by projection 18, carries barrel 2 forward. The forward motion of the barrel assembly comprising spring-positioning rod 36 along with barrel stop 54 and barrel 2 along with projection 18 continues until forward stop 50 and depression 52 strike elongated recess 42. At this point the forward end 32 of breech block 6 strikes the forward face of the breech stop, bush 64, that is. The breech assembly has accordingly also arrived at its rearmost position.

It will also be evident from FIG. 3*d* that barrel 2 has in the meantime tilted to such an extent that projection 18 rests against the rear end of spring-positioning rod 36 and that transverse pin 44 and depression 52 are securely mutually engaged in their stabilizing position.

Bush 64 is now in its farthest-forward position as illustrated in FIG. 3*d*. This position is dictated by the engagement of pin 62 in slot 60, meaning that pin 62 rests against the forward end of slot 60.

Figure 3E:
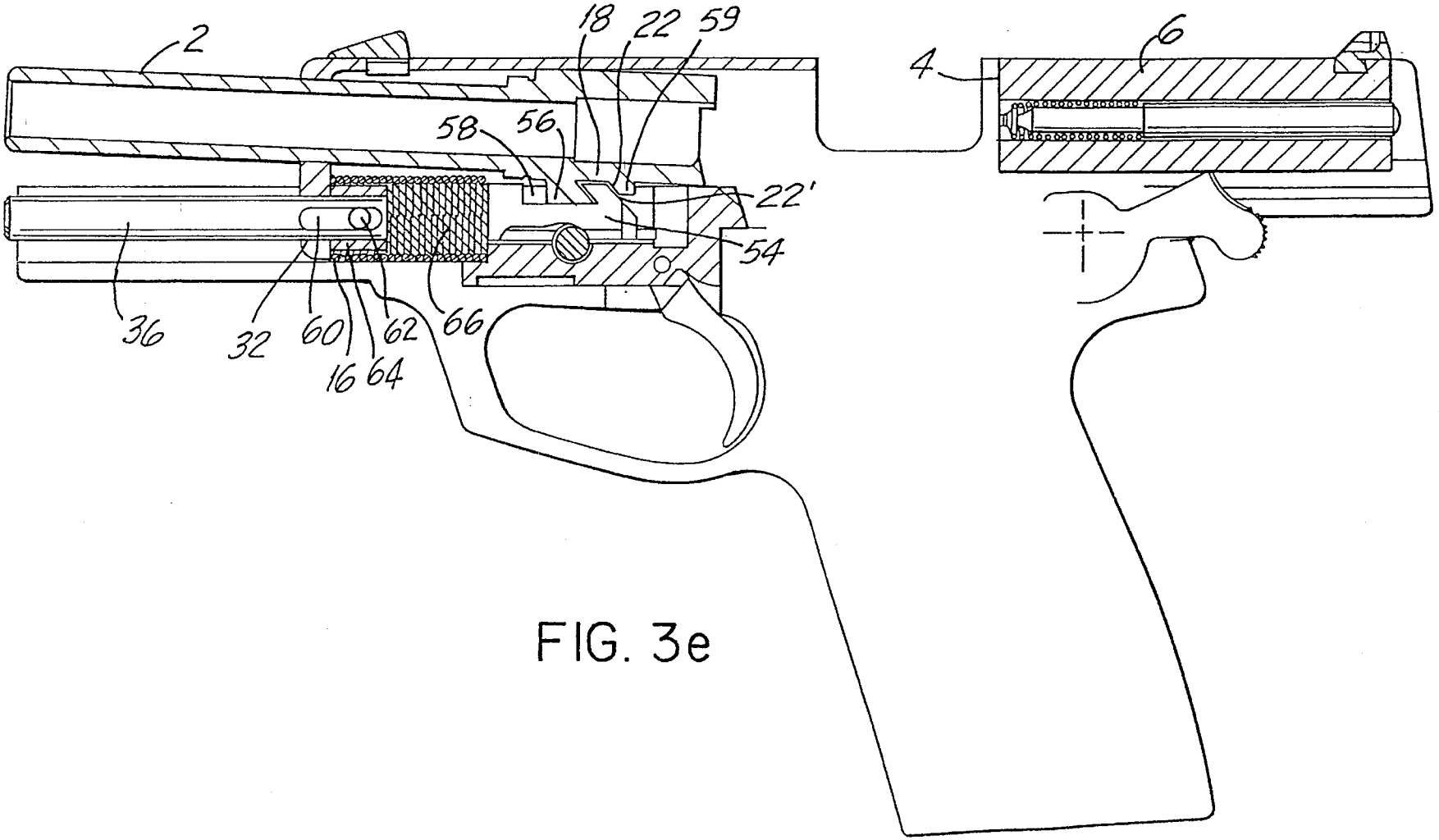

If the coordination between buffering spring 66 and recoil spring 16 is not precise enough to ensure that the breech assembly is all the way to the rear when it impacts against bush 64, buffering spring 66 will again function as an attenuating spring but now in conjunction with recoil spring 16. The forward end 32 of breech block 6 will force bush 64 back a little farther against the force of spring 66 to the extent allowed by the engagement between pin 62 and slot 60 as illustrated in FIG. 3*e*. Spring-positioning rod 36 will simultaneously remain in the position dictated by the stabilizing engagement and captured by barrel 2. This situation can occur for example when ammunition other than that specifically intended for the weapon and accordingly for its particular spring characteristics is employed. Various calibers usually necessitate readjustment of the springs, which can be accomplished by replacing at least one of them with another type.

Once it has arrived in its rearmost position, breech block 6 will tend to return to its initial forward position subject to recoil spring 16 and, in the event of inadequate spring coordination, subject initially to buffering spring 66 as well. Breech block 6, as it executes its closing stroke, now transfers the unillustrated uppermost cartridge from the unillustrated clip into the chamber 8 constituted by the rear of barrel 2.

Once face 4 reaches barrel 2 again, it will force it up and forward over the locking section 22 of the extension 59 of projection 18 to the same extent as the locking stroke and the locking section 22' of barrel stop 54 until the forward face of extension 56 strikes the forward wall of the upper recess 58 in the rear of spring-positioning rod 36. The free end of the truncopyramidal extension 59, the end facing barrel stop 54, rests snug in this position against the facing free area of barrel stop 54. It is accordingly ensured that barrel 2 will always assume the same position relative to the sight mounted on breech block 6. The ready-to-fire position is again present as illustrated in FIG. 3*a*.

The aforesaid automatic pistol can be modified within the scope of the present invention. The cams and impact surfaces need not necessarily be on the bottom of the barrel. They can also be grooves in or ridges on the barrel. The functions of elongated recess 42, of the bottom 46 that acts as a cam, and of depression 52, can be assumed by cams on each side of the barrel and on the barrel, the grip assembly, and/or the breech block.

Figure 4:
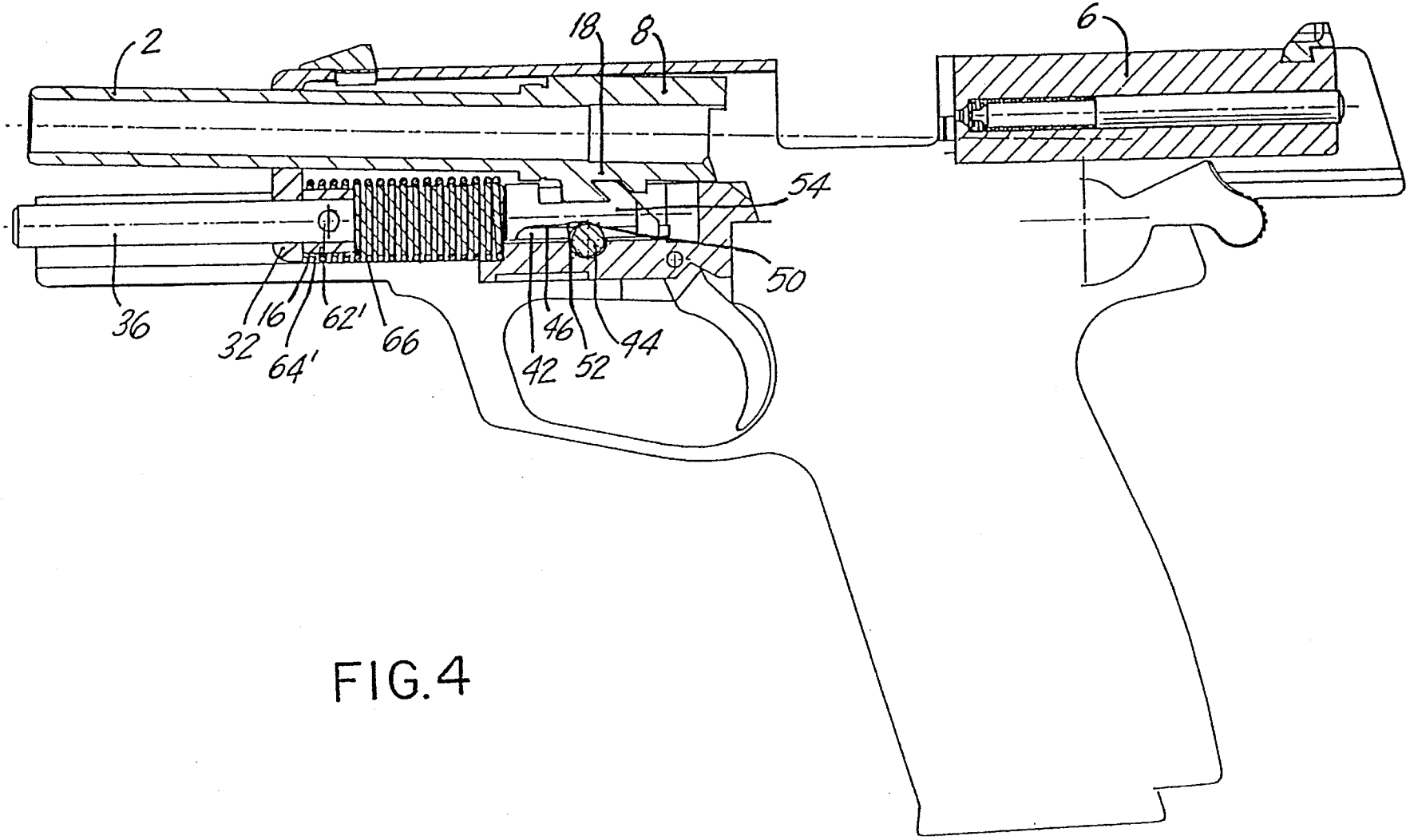
FIG. 4, finally, illustrates another embodiment at the stage illustrated in FIG. 3*e*.

The embodiment illustrated in FIG. 3 can in particular be modified as illustrated in FIG. 4. The bush 64 in this embodiment is rigidly secured to spring-positioning rod 36 and there will be no need for a slot 60. The embodiment illustrated in FIG. 4 is illustrated only in operation, which is the state during which it functions differently from the embodiment illustrated in FIG. 3. This state corresponds to the state illustrated in FIG. 3*d*.

What is claimed is:

1. A hand-held firearm comprising a) a barrel assembly, including two subassemblies, the first subassembly comprising a barrel having a fixedly attached projection and the second subassembly comprising a spring positioning rod and a fixedly attached barrel stop, the first subassembly being movable in relation to the second subassembly, and the second subassembly being movable along with the first subassembly between a forward stop and a rear stop disposed along a grip assembly;

b) a breech assembly including a movable breech block having a forward end, a recoil spring positioned about the spring positioning rod and having a spring force, the breech assembly moving back and forth essentially in the same direction as the barrel assembly between a forward and closed position and a rear and open position, moving out of the closed position and into the open position against the spring force of the recoil spring and, upon completion of the moving back and forth, the breech assembly rests against the grip assembly;

c) a buffering spring for tensioning the barrel assembly toward the forward stop and for buffering the contact of the barrel assembly on the rear stop; and wherein d) the movements of the recoil spring and the buffering spring are correlated such as to ensure that the breech assembly strikes the grip assembly essentially at the same time as the barrel assembly contacts the forward stop, thus reducing the momentum of the breech assembly onto the grip assembly by the momentum of the barrel assembly.

2. The firearm as in claim 1, wherein the breech assembly in the closed position interlocks with the barrel assembly.

3. A hand-held automatic firearm with a cartridge-chambering mechanism actuated by a breech assembly, comprising a) a barrel assembly, including two subassemblies, the first subassembly comprising a barrel having a fixedly attached projection and the second subassembly comprising a spring positioning rod and a fixedly attached barrel stop, the first subassembly being movable in relation to the second subassembly, and the second subassembly being movable along with the first subassembly between a forward stop and a rear stop disposed along a grip assembly;

b) a breech assembly including a movable breech block having a forward end, a recoil spring positioned about the spring positioning rod and having a spring force, the breech assembly moving back and forth essentially in the same direction as the barrel assembly between a forward and closed position and a rear and open position, moving out of the closed position and into the open position against the spring force of the recoil spring and, upon completion of the moving back and forth, the breech assembly rests against the grip assembly;

c) a buffering spring for tensioning the barrel assembly toward the forward stop and for buffering the contact of the barrel assembly on the rear stop; and wherein d) the movements of the closure spring and the buffering spring are correlated such as to ensure that the breech assembly strikes the grip assembly essentially at the same time as the barrel assembly contacts the forward stop, thus reducing the momentum of the breech assembly onto the grip assembly by the momentum of the barrel assembly.

4. The firearm as in claim 1, wherein the grip assembly is at least partly made of plastic composite.

5. The firearm as in claim 2, further comprising a clip and wherein a) the grip assembly is a frame, b) the breech block executes its return stroke adjacent to the clip, c) the interlocking breech assembly and barrel assembly travel the initial phase of the return stroke interlocked until the barrel assembly strikes the rear stop and stops moving, and d) the barrel projection engages during the initial phase of the return movement a barrel stop supported by the buffering spring on the grip assembly.

6. The firearm as in claim 5, wherein a) the barrel pivots in the breech assembly, whereby a1) the barrel includes a forward section which is supported by the forward end of the breech assembly; and a2) the barrel includes a rear section which tilts downward when the rear section contacts the barrel stop, and b) the barrel projection and the barrel stop include complementary cam sections that disengage or reengage the barrel from the breech block so as to hinder the barrel projection and barrel from engaging with each other and transmit motion in both directions while the breech block is disengaged from the barrel.

7. The firearm as in claim 6, wherein a) the recoil spring is a helical spring which rests on the spring-positioning rod located below and essentially parallel to the barrel and having a forward end disposed on the forward end of the breech block and having a rear end disposed on the grip assembly, b) the barrel stop disposed on the rear end of the spring-positioning rod, and c) the spring-positioning rod moving back and forth against the force of the buffering-spring.

8. The firearm as in claim 7, wherein the buffering spring rests on the spring-positioning rod inside the recoil spring having a forward end positioned against a projection disposed on the spring-positioning rod, and having a rear end positioned along with the recoil spring on the grip assembly.

9. The firearm as in claim 8, wherein the projection is a bushing having a front end f which constitutes a rear breech-block stop disposed on the buffering spring against the frame.

10. The firearm as in claim 9, wherein the bushing controllably slides along the spring positioning rod and the buffering spring forces the bushing forward out of its disengaged position.

11. The firearm as in claim 10, wherein a transverse pin extends through a slot in the spring-positioning rod and is releasably secured to the bushing on both sides of the spring-positioning rod.

12. The firearm as in claim 9, wherein the bushing is secured to the spring-positioning rod.

* * * * *